US006237189B1

(12) United States Patent
Maurer et al.

(10) Patent No.: US 6,237,189 B1
(45) Date of Patent: May 29, 2001

(54) VACUUM CLEANER SUCTION NOZZLE CONFIGURATION

(75) Inventors: Edgar A. Maurer, Canton; Richard A. Wareham, North Canton; David W. Moine, North Canton; Kurt D. Harsh, North Canton; Kenneth L. Symensma, Canton, all of OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/459,002

(22) Filed: Dec. 10, 1999

Related U.S. Application Data

(63) Continuation of application No. 08/853,838, filed on May 9, 1997, now Pat. No. 6,006,402.

(51) Int. Cl.[7] ..... A47L 5/30

(52) U.S. Cl. ..... 15/383; 15/415.1

(58) Field of Search ..... 15/350, 351, 366, 15/368, 383, 384, 415.1

(56) References Cited

U.S. PATENT DOCUMENTS

| | | | | |
|---|---|---|---|---|
| 2,475,808 | * | 7/1949 | Storm | 15/383 X |
| 4,178,653 | * | 12/1979 | Tschudy | 15/383 |
| 5,513,418 | * | 5/1996 | Weber | 15/383 |
| 5,983,449 | * | 11/1999 | Thomas et al. | 15/383 |

* cited by examiner

*Primary Examiner*—Chris K. Moore
(74) *Attorney, Agent, or Firm*—A. Burgess Lowe; Bruce P. Watson; Thomas R. Kingsbury

(57) ABSTRACT

A vacuum cleaner suction nozzle is provided with inner front and rear ducts and a duct cover piece disposed within the agitator chamber. This chamber is formed by a tunnel piece that is at least partly user observable from above the nozzle. The nozzle includes a hood piece which melds with its underbody at, at least, a portion of their juncture. This is occasioned by an offset in their underbody.

13 Claims, 7 Drawing Sheets

FIG.-5
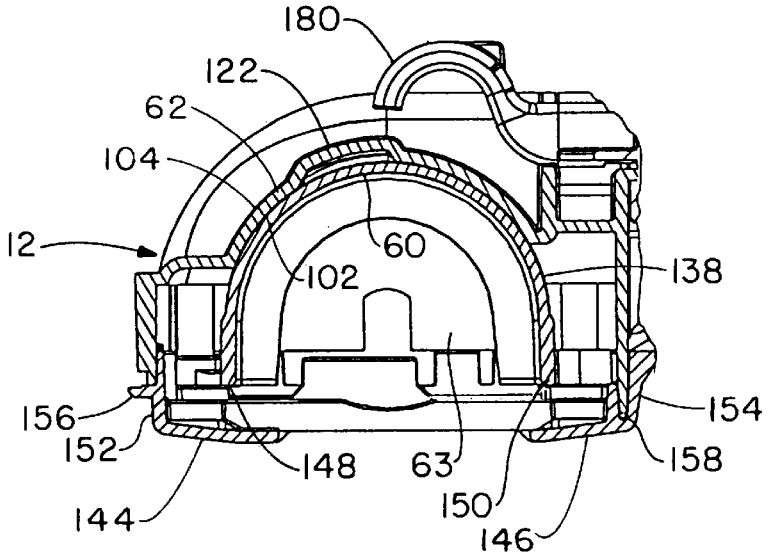
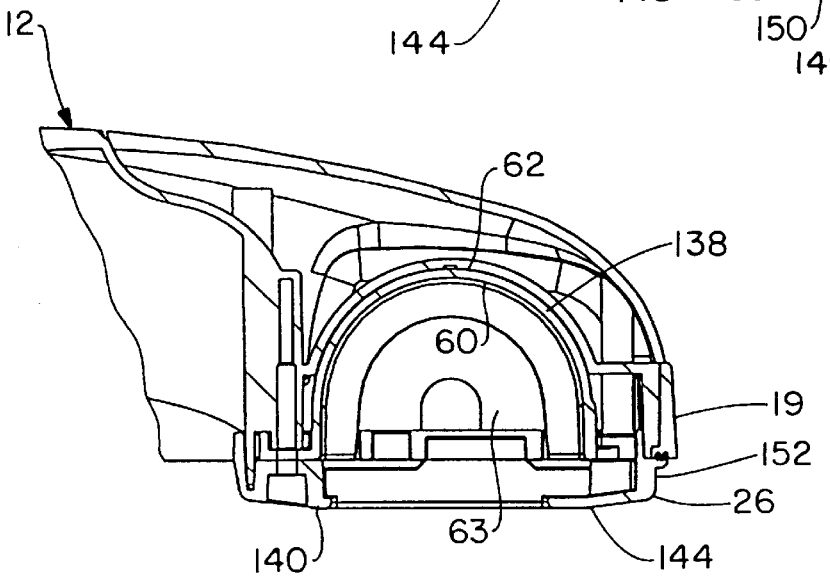
FIG.-6
FIG.-7
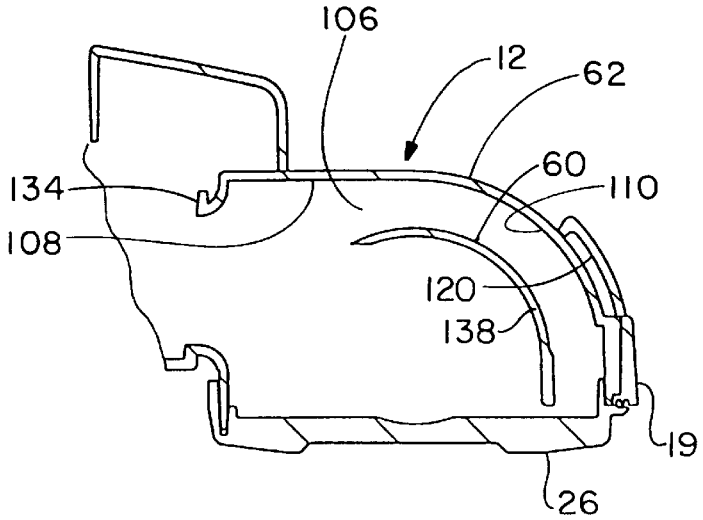

VACUUM CLEANER SUCTION NOZZLE CONFIGURATION

This application is a continuation of U.S. application Ser. No. 08/853,838 filed May 9, 1997, now U.S. Pat. No. 6,006,402, issued Dec. 28, 1999.

BACKGROUND OF THE INVENTION

1. Field of the Invention

This invention relates to a vacuum cleaner and, more specifically, to a vacuum cleaner nozzle arrangement.

2. Summary of the Prior Art

It is known in U.S. Pat. No. 5,513,418, owned by a common assignee, to provide forward and rearwardly disposed suction ducts that extend along the front and back sides of a suction nozzle to lead suction air to a rearwardly extending fan communicating duct. It is also known from this patent to make an outer covering piece of a communicating duct portion extending between the front and back sides of the suction nozzle removable. It is also known from this patent to make the agitator tunnel an inner structure in its nozzle. It is also generally known to provide a hood structure which either sits on its underbody or obviously overlaps it.

However, the advantageous disposition of the suction nozzle duct cover within the confines of an agitator chamber or the use of an agitator tunnel arrangement easily discemable by the user of the cleaner or a pleasing nozzle outside geometry such as the presentation of a smooth line between the hood and its underbody has not been known to heretofore be contemplated in the prior art.

Accordingly, it is an object of the invention to provide an improved suction nozzle configuration.

It is a further object of this invention to provide a suction nozzle with either front and/or rearward ducting which may be accommodated in a nozzle having as a structural requirement an inboard duct cover.

It is a still further object of the invention to provide an abbreviated suction nozzle hood which merges with a necessary suction nozzle under carriage to smoothly form at least a portion of the suction nozzle outer and top peripheral surfaces.

It is a further object of the invention to abbreviate the periphery of the suction nozzle hood so that the outer outlines of the agitator tunnel chamber is viewable to the user so that this structure serves as a portion of the outer, observable, suction nozzle per se.

It is a still further object of the invention to provide an improved suction nozzle structure which includes forward and rearward suction nozzle ducts.

It is an even further object of the invention to provide an improved removable suction nozzle duct cover structure and arrangement.

SUMMARY OF THE INVENTION

The invention is provided in a suction nozzle which includes rear handle journaling structure, rear wheels and more forwardly disposed intermediate wheels. These last mentioned wheels are carried on a pivot carriage structure on the suction nozzle so that they may pivot inwardly and outwardly of the suction nozzle to thereby adjust its height. All the structure so far related is carried on a main body for the suction nozzle and may be seen firstly in commonly owned U.S. patent application, Ser. No. 08/824,769, filed on Mar. 21, 1997.

Surmounting this main body, at least in the front portions, is a hood piece formed with an opening near its front which includes, in the embodiment illustrated, an open discontinuity at the hood piece inner side which opens downwardly. The hood piece, aside from this discontinuity, only extends partially backwardly from its front covering position on the main body so that an observable vertical and horizontal parting line is seen generally at about one half the fore to aft depth of the suction nozzle. The main body surface is recessed in at least part of its area mating with the hood so that the surface on each side of the parting is, within manufacturing tolerances, as smooth and coincident as possible to yield a very attractive overall nozzle presentation.

Within the opening formed by the discontinuity in the hood, at its rightward side, is an observable portion of the outside of a cylindrical shell agitator tunnel chamber (looking from the front of the suction nozzle), and the outside of a cross duct communicating with a forward and a rearward suction nozzle duct (to the left of the agitator tunnel chamber). A suction nozzle height adjusting lever and its indexing means is also apparent, situated generally inwardly and behind the agitator chamber tunnel.

A front duct is partly formed on its upper side by an angled face formed just outside the agitator tunnel, proper, on the inner front side of an agitator housing. This face angles upwardly from its outside end to provide a constant carrying velocity attribute to the front duct. This face terminates in a smooth, curvilinear manner adjacent a formed cross duct portion in the agitator tunnel extending across the inside of the agitator tunnel near one of its ends. A short duct face is also formed on an opposite inner side of the cross duct portion and on a rear inner side of the agitator tunnel.

A rear duct face also angles upwardly within the agitator tunnel and extends generally from a hollow, generally semi-cylindrically shaped belt guard, mounted adjacent an opposite end of the agitator housing from the cross duct portion, just outside the agitator tunnel.

The generally semi-cylindrical belt guard is formed integrally with an inner, removable duct cover which is in the shape of a substantially semi-cylindrical shell and extends internally within and generally for the full length and width of the agitator chamber tunnel. The duct cover's radically outer semi-cylindrical surface forms the inside wall of the inner and outer duct. The duct cover is screw mounted to the agitator tunnel and, because it is internal to the agitator tunnel, any leakage into it would, advantageously, tend to impose more suction in the agitator chamber and thereby provide a suction nozzle with more effective cleaning ability.

The front and rear ducts for the suction nozzle are completed by a bottom plate which is screwingly mounted to the agitator tunnel. It includes front and rear inwardly and sidewardly extending lips that form the final bottom sides of the suction nozzle. The front and rear lips also afford the bottom sides of the forward and rearward ducts. These two lips are vertically spaced from the bottom terminations of the duct cover, at their inner terminations to thereby permit the easy slot entrance of suction air, air entrained dirt, and agitator driven dirt into both the forward and rearward ducts. The air and dirt are transported from there to a rearwardly connected suction hose fitting for eventual movement into a motor-fan arrangement (not shown) for the vacuum cleaner of which the suction nozzle is a part.

BRIEF DESCRIPTION OF THE DRAWINGS

Reference may now be had to the accompanying Drawings for a better understanding of the invention, both as to its organization and function, with the illustration being only exemplary and in which:

FIG. 5 is a truncated cross-sectional view of the suction nozzle of FIG. 1 taken on lines 5—5 thereof with the hood removed;

FIG. 6 is a truncated cross-sectional view of the suction nozzle of FIG. 1 taken on line 6—6 thereof with the hood removed;

FIG. 7 is a truncated cross-sectional partially diagrammatic view of the suction nozzle of FIG. 1 taken of line 7—7 thereof with the hood removed;

DETAILED DESCRIPTION OF THE INVENTION

Figure 10:
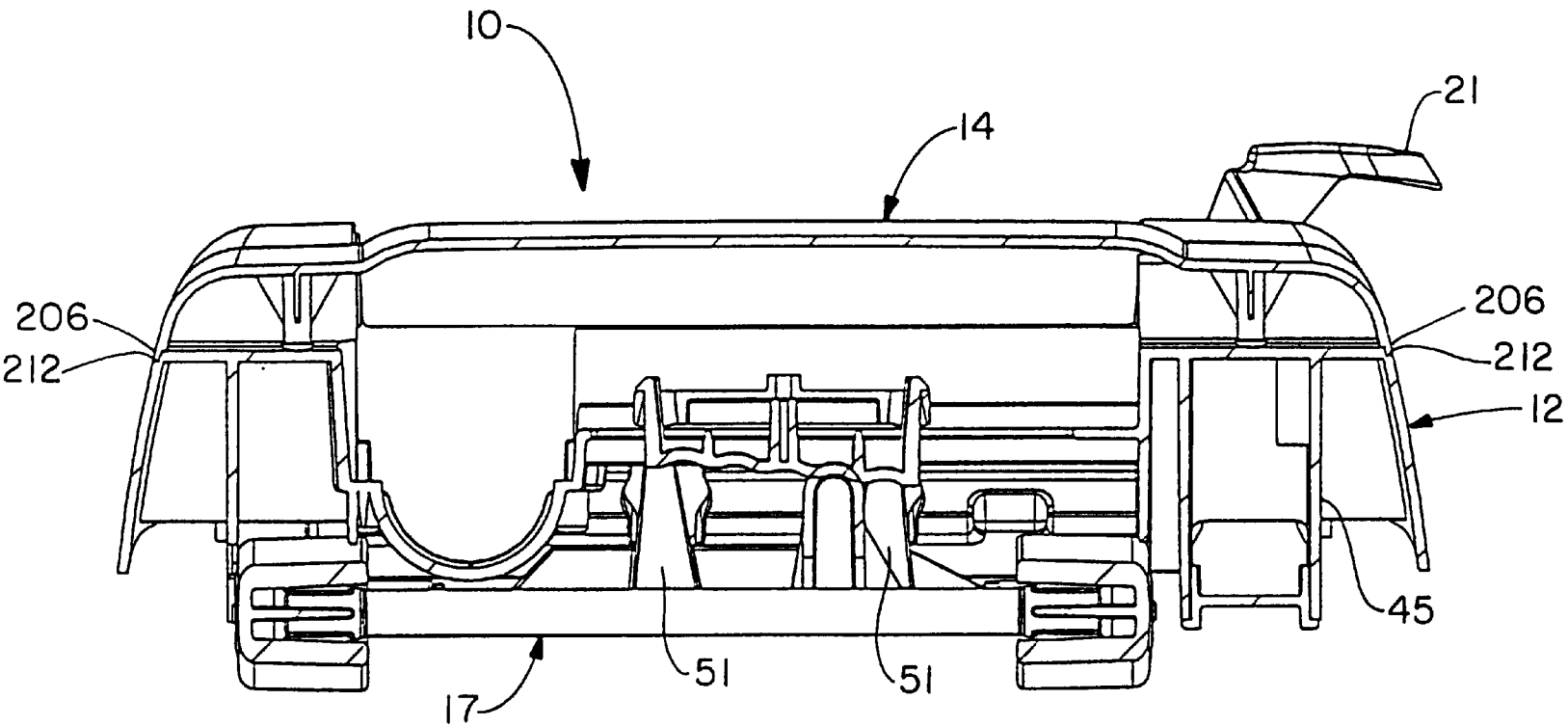
FIG. 10 is a cross-sectional view of the suction nozzle.

There is shown most specifically in FIGS. 1–4, a suction nozzle 10 having a rather extensive main body 12 surmounted by an abbreviated hood 14. The main body includes rear wheels 16, 16 and a forward but intermediately disposed pivoted, height adjustable wheel carriage 17 (FIG. 10—not fully shown but fully disclosed in previously mentioned U.S. patent application Ser. No. 08/824,769). The suction nozzle 10 also includes sidewardly disposed litter picks 18, 18 and a discontinuity 20 formed partially by a cutout portion of the hood and partly by a forward wall termination 22 of the main body 12. A furniture guard 19 extends around the suction nozzle 10 front and sides to terminate behind the litter picks 18, 18 and a foot release pedal 211 is disposed at the nozzle's rearward edge.

Figure 4:
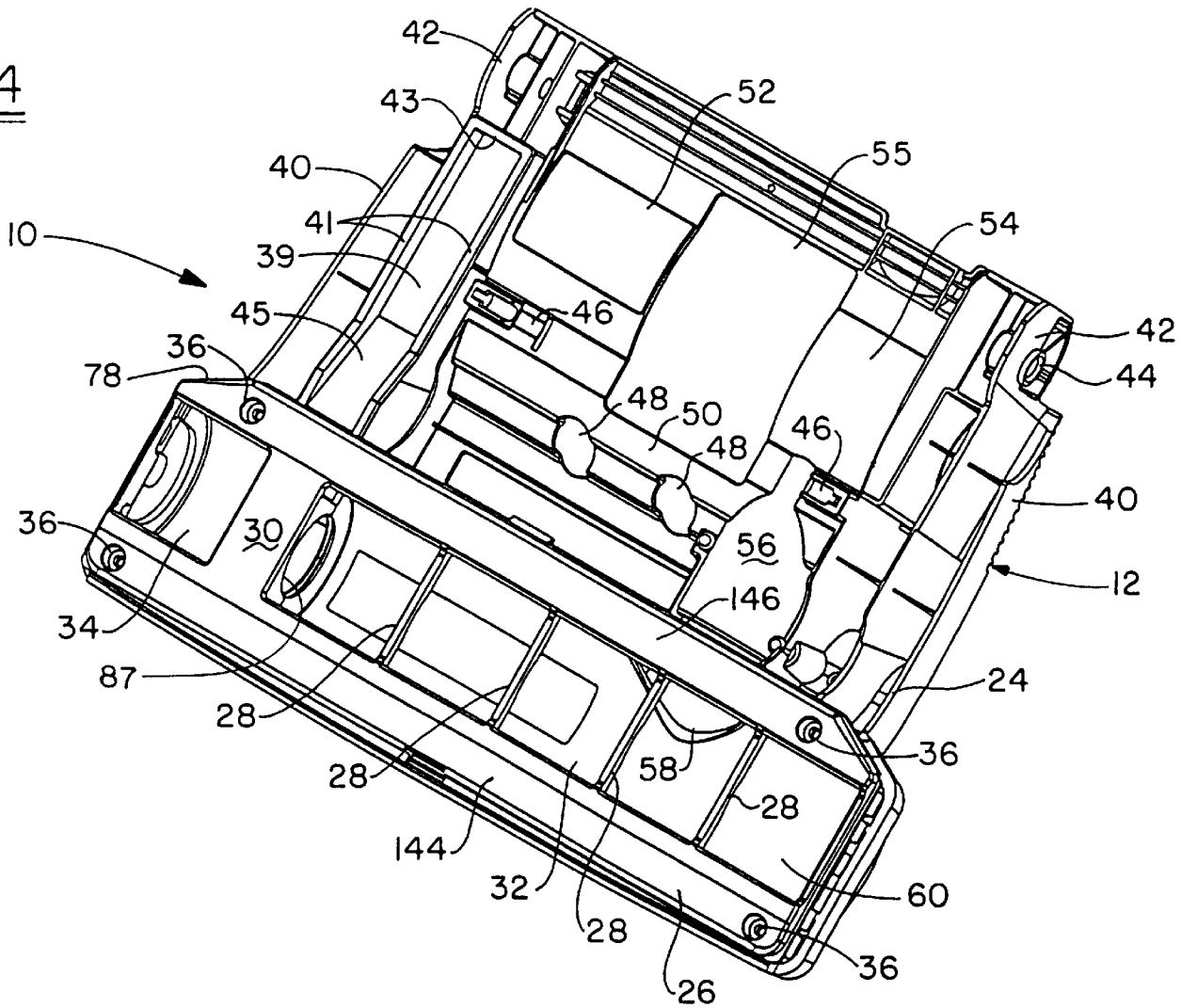
FIG. 4 is a similar view to FIGS. 2 and 3 with the nozzle bottom plate in place.
Figure 8:
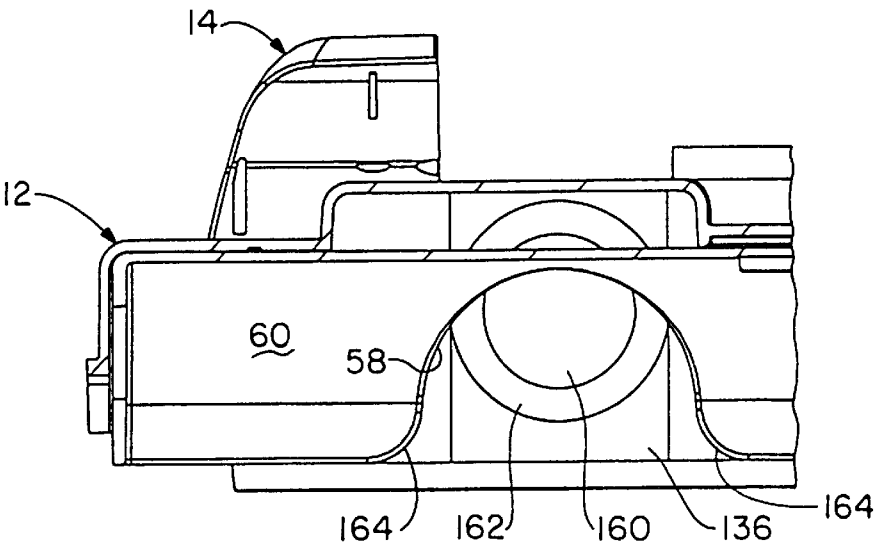
FIG. 8 is a cross-sectional view of the suction nozzle.

With specific reference now to FIG. 4, the suction nozzle 10 includes on its bottom side 24 an abbreviated bottom plate 26 having cross bars 28, 28, 28, 28 and an adjacent belt cover portion 30. A suction opening 32 is disposed at the cross bars 28 and a suction opening 34 on the far side of belt cover portion 30. The bottom plate 26 is securely mounted to the bottom side 24 of the main body 12 by screws 36, 36, 36 and 36 which extend into bosses 38, 38, 38 and 38 formed in main body 12. The bottom plate 26 also includes a rearwardly extending cover 39 with offset vertical strengthening walls 41, 41 and 43. This cover forms the bottom side for a belt guard housing 45, integral with the main body 12.

Rearwardly of the bottom housing plate 26, the suction nozzle 10, along its sides, includes a pair of spaced short, integral, outer vertically extending side walls 40, 40 that are stepped inward by a pair of right angled rear portions 42, 42. These form wells for the mounting of the rear wheels (not shown in FIG. 4) through the aegis of wheel axle mounting bores 44, 44 (only one shown). Forwardly and inboard of the rear wheel mounting wells are a pair of mounting slots 46, 46 for mounting the adjustably pivoted wheeled carriage U.S. Ser. No. 08/824,769. This wheeled carriage furnishes support for the nozzle 10 forwardly of the rear wheel wells.

A pair of generally centralized openings 48, 48 are provided in the main body 12 by a stepped, angled, generally vertically extending integral wall 50. This wall is disposed slightly forwardly of the mounting slots 46, 46. These openings afford clearance for prongs 51, 51 mounted integrally with the aforesaid wheeled carriage 17 (U.S. Ser. No. 08/824,769). They are engageable by an moved by a projection on the hard bag or handle portion (not shown) of the cleaner when the handle portion is disposed in a storage position to pivot the wheeled carriage 17 outwardly or downwardly to raise the nozzle 10 relative the floor in a conventional manner.

Behind the angled, stepped wall 50 of main body 12, main body 12 is formed with a pair of downwardly projecting concave sections 52, 54 (concave in top-view as seen in FIG. 11) that extend axially sidewardly relative to the main body 12. The concave section 52 is slightly smaller than the concave section 54 since it accommodates a smaller diameter hard bag motor housing section (not shown) while the concave section 54 serves as a base for the larger hard bag fan housing section (not shown). Mediate these two sections is a large rectangular hole 55 (in plan) which accommodates a larger end of the hard bag motor housing (not shown).

The concave section 54 has merging with it, a concave section 56 (concave in top-view as seen in FIG. 11). The concave section 56 is transverse to it and extends towards forward portions of the main housing and terminates forwardly just short of a cutout 58 (both to be described later) in an agitator housing or duct cover 60 mounted within a generally cylindrical agitator tunnel 62 (See FIG. 2) formed in main body 12. The tunnel 62 forms, at least partly, the outer envelope for an agitator chamber 64. This tunnel includes semi-cylindrical shaped stepped ends 76, 76 having semi-cylindrical wells 65, 65 for the lodgement of the ends of an agitator (not shown). The concave section 56 provides clearance for a hose fitting (also not shown) extending from the cleaner hard bag (not shown).

An open slot 66, disposed intermediate the front and back sides of main body 12, extends parallel to the front and back sides of the main body 12. The open slot 66 provides an opening for the actuating part of the height adjusting arrangement (not shown) for wheel carriage 17 to extend through. Rightward and leftward lattice-like ribbing 70, 70 forms strengthening structure for the main body 12. This insures sufficient structural rigidity and durability.

Figure 3:
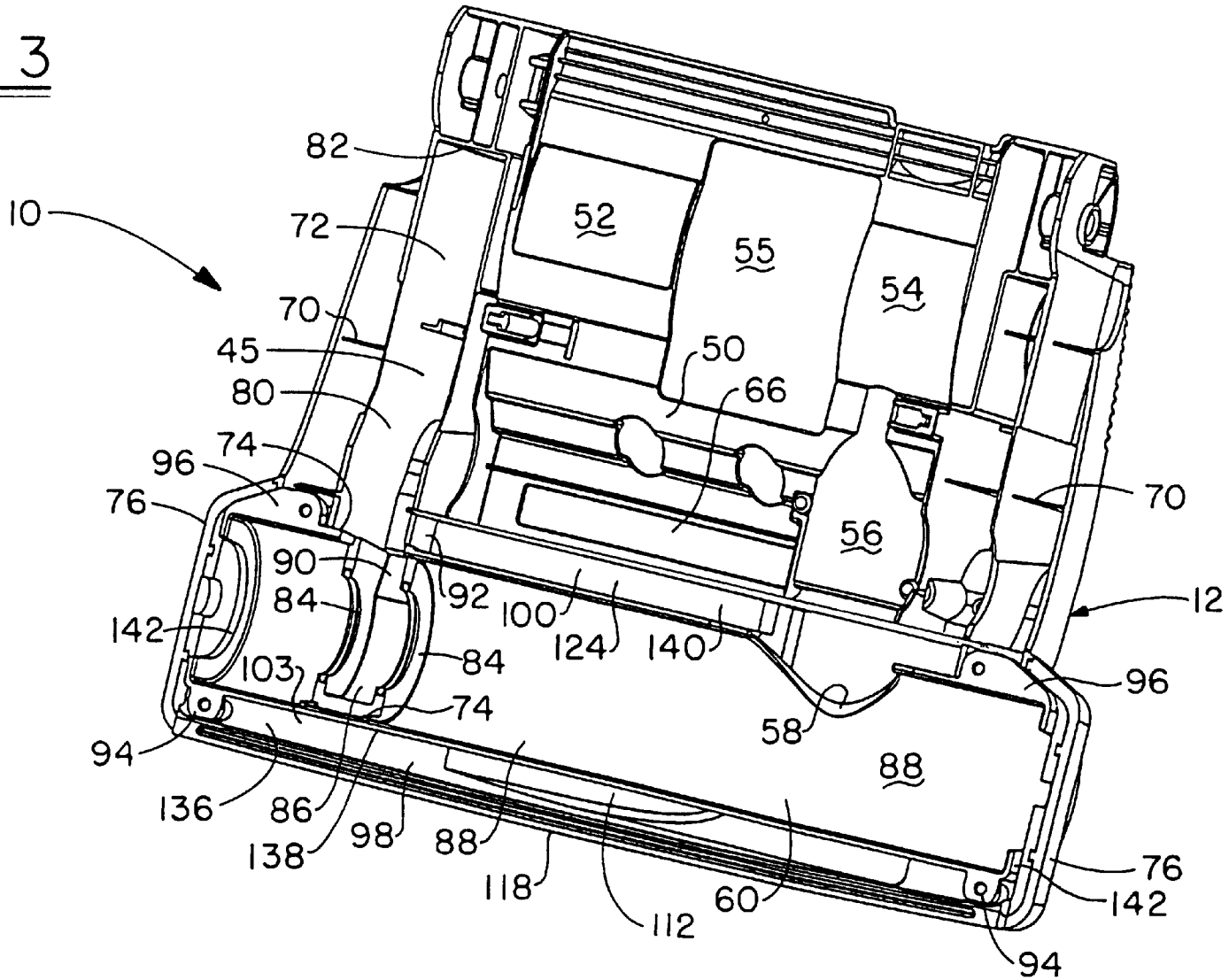
FIG. 3 is a right side, bottom perspective like FIG. 2 with the duct cover in place.

Turning now specifically to FIGS. 3 and 4, it can be seen that the belt guard cover 39 (shown in FIG. 4) obscures a well 72 (shown in FIG. 3) in belt guard housing 45 for disposition of a belt (not shown) that extends roughly between the leftward termination of the fore and aft middle of motor housing covering concave section 52 and a forward terminating portion 74 of the duct cover 60. The duct cover 60 takes the form of an elongate substantially semi-cylindrical shell and extends longitudinally between side ends forwardly extending main body vertical end walls 76, 76. The vertical end walls 76, 76 form the ends of the agitator chamber 64. The vertical end walls 76, 76 join at their rears to the vertically extending side walls 40, 40 by angle transition walls 68, 68.

The well 72 for the belt (not shown) enclosed by the belt guard housing 45, is bordered throughout much of its length by reinforcing and sheltering elongated integral main body walls 80, 80. These walls are seen as extending generally from the rear side of the agitator chamber 64 to nearly the rear side of concave section 52. They terminate in a rear cross wall 82. At their fronts, the main body walls 80, 80 extend far enough forwardly in the suction nozzle 10 (see FIG. 3) to space the duct cover 60 sufficiently forwardly to accommodate requisite rear ducting (to be described later).

The duct cover 60, at the belt end, includes a pair of short vertically upstanding, laterally spaced, inner walls 84, 84 having arcuate top sides to provide therebetween for belt guidance and thereon for agitator bearing seals (not shown). These walls are parallel and spaced from each other to provide substantially full sealing for the belt (not shown) and extend downwardly and outwardly sufficiently to form a cradle 86 for the agitator (not shown) which they bearingly receive. There are correspondingly shaped pieces 87 (only one of which is shown in FIG. 4) on the inside of the bottom plate which serve as the other half of an agitator seal.

An inside surface 88 of the duct cover 60 includes a rearwardly disposed flat 90 that provides clearance for the belt and its operation. Adjacent to this flat, the main walls 80, 80 of the belt guard housing 45 are extended forwardly by wall sections 92, 92 so as to aid in the aforesaid duct cover 60 spacing. This duct cover 60 is also spaced within the tunnel 62 by integral screw receiving lugs 94, 94, 96, 96 which are disposed on its ends so that its forward and rearward terminating sides form forward and rearward suction ducts 98, 100 with the inner surface of the tunnel 62. These two suction ducts form the main flow path for suctioned air moving through the suction nozzle and into the hose (not shown). This hose is disposed above the concave shaped, hose receiving concave section 56 of the main body 12. Suctioned air also, of course, moves through the cutout 58 to this same hose. The partially cylindrical volume inside the duct cover 60 and between the two suction ducts 98, 100 in the suction nozzle IO, that is, the agitator chamber 64, serves as a lower pressured suctioning region which is also depressurized by any air leakage between the forward and rearward ducts around the duct cover 60 and the agitator chamber.

The tunnel 62 in the main body 12 is a generally cylindrical shell-like piece on both its inside and outside surfaces 102, 104. The tunnel 62 (FIG. 2) includes adjacent its inside forward surface a forward angled face 103 which angles more deeply toward the interior of the main body 12 (downwardly in FIG. 2) as the face progresses rightwardly. It thereby forms a ramp in the tunnel 62 as it extends towards the tunnel's outlet. The tunnel's least depth is just outside of the most leftward and forward boss 38, just outwardly from adjacent with the belt flat 90, and angles inwardly and upwardly from there towards an enlarged cross flow channel or duct 106 which is inset from or formed by a recess in the inside surface 102 of the tunnel 62.

Figure 1:
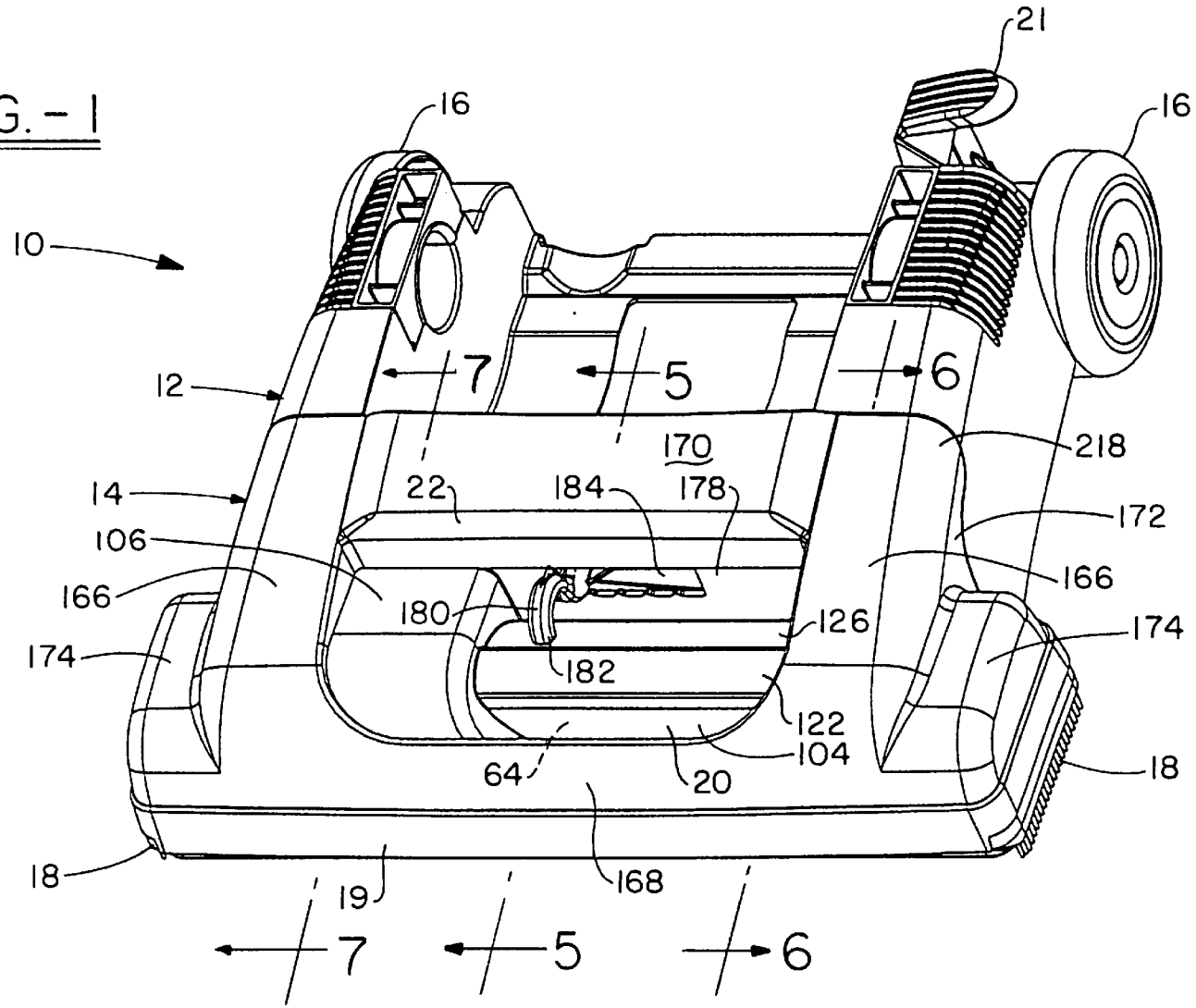
FIG. 1 is a right side, upper perspective top view of a suction nozzle incorporating the invention.
Figure 2:
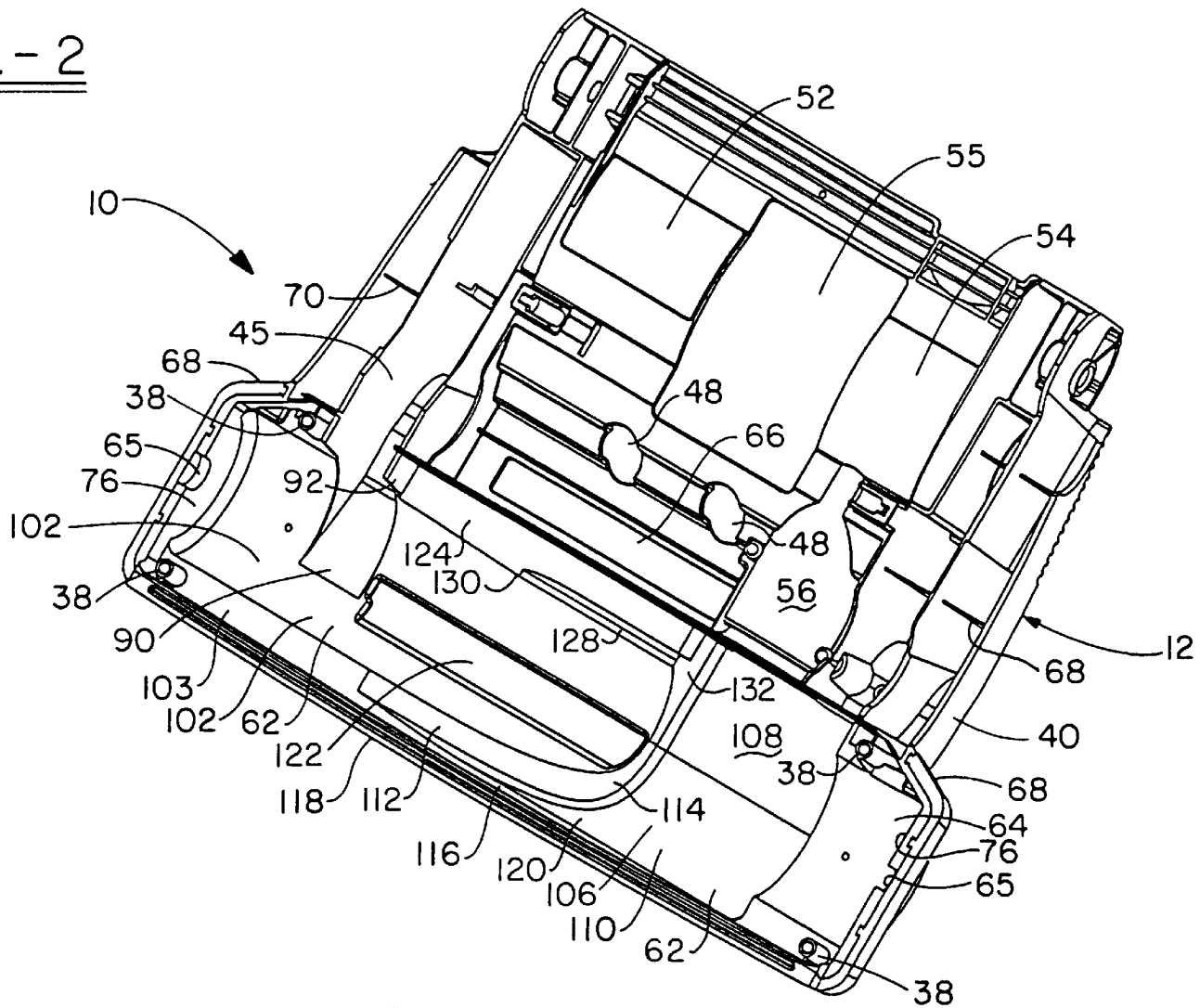
FIG. 2 is a right side, bottom perspective view of the same nozzle and looking upwardly with its duct cover and bottom plate removed.

As best illustrated in FIGS. 2 and 7, the cross flow channel section 106 includes a flat surface inner portion 108 joining into a curvilinear, semi-cylindrical surface outer portion 110. Both these surfaces are inset or disposed upwardly relative to the surface 102 of tunnel 62, as best seen in FIG. 2. The inner portion 108 is made flat because of molding requirements, while the outer portion 110 provides a smooth mergence with the inner portion 108 and an elongated sidewardly extending curvilinear face portion 112. This face portion merges smoothly with the outer portion 110, at that end, in a rounded expanding inset curve 114 and streamlines airflow at the suction nozzle 10 front side towards outer surface portion 110. At its other end, the curvilinear face 112 merges smoothly with the angle face of the ramp 103. The curvilinear portion 112 is not quite as wide as the face ramp 103 to provide a small ledge 116 for the outer portion 110. This spaces it inwardly of a front wall 118 of main body 12 and accommodates a slight side to side bow in this front wall. The ledge 116 is flat and spaced outwardly of the curvilinear face portion 112. The front inner shape of the tunnel 62 is completed by a curvilinear wedge shaped piece 120, formed between the expanding curve 114, the curvilinear surface portion 110 and the inset 116. It forms a smooth continuous surface with these curved surfaces. The wedge shaped piece 120 forms a streamlined continuation of the curve of the outer portion 110.

Medially of the tunnel 62 and extending parallel to its linear extent is an inset in the inside surface 102 that forms a generally rectangular pad 122 in the tunnel's outer surface 104. This pad provides a convenient preferably flat, or alternatively gently curved substantially flat (see FIG. 5) surface for graphics use on the top side of the suction nozzle. Material is preserved in the formation of raised pad 122 by insetting the inner surface 104 of the tunnel 62.

The inner surface of the tunnel 62 is substantial completed by another angled face 124 which forms a downwardly facing air converging ramp on the rear side of the nozzle. This ramp angles also inwardly as it moves towards and past a centerline of the suction nozzle so that it extends upwardly within the tunnel 62 and its internal semi-cylindrical surface 102. It extends from the inner of the extended walls 92. An inset in the top surface 126 (FIG. 1) forms a tapered vertical wall 128 adjacent rearward terminating edge 130 of semi-cylinder surface 102. Wall 128 is formed as a smooth continuation of tunnel 62. The wall 128 extends approximately medially along the angled face 124 from its rightward termination and reduces its width slightly but not disadvantageously to any marked degree.

The angled face 124 has a rearwardly disposed, generally vertically extending joining wall 132 that extends from the angled face forwardly across the flat surface 108 of flow channel 106 to meld with the expanding curve 114. The angled face 124 then extends between the short extended wall section 92 of belt guard housing 45 to the flat 108 adjacent the cutout 58.

Turning again now to FIG. 3, with the description afforded relating to FIG. 2 kept in mind, it appears clear that three sides of a front suction nozzle duct 136 are formed, respectively, by the front wall 118 of the main body 12, by the angled face 103 and curvilinear face portion 112 and by an outer shell side 138 (FIGS. 5–7) of the duct cover 60. Because of their configuration this duct has an expanding configuration that provides a substantially constant velocity and suction across the forward duct 138. A rear duct 140 is provided with three sides by the angled face 124, by the joining wall 132, and by the outer shell side 138 of the duct cover 60. Because of this configuration this duct likewise has an expanding configuration that provides a substantially constant velocity and suction across the forward duct 140.

The cross flow channel 106 for the front duct 136 is formed by the inset flat and curvilinear surface portion 108 and 110, respectively, and by the shell side 138 of the duct cover 60.

The duct cover 60 is also easily removable from the suction nozzle 10 by removal of the screws 36, 36, 36, 36 so that the front and rear ducts 136 and 140, respectively, can be cleaned of any dirt, dust or debris adhering to their inside surfaces. In this regard, it should be noted that leakage into either of these ducts, advantageously, is not from atmosphere but from within the agitator chamber 64. This results in a lowering of the pressure in the agitator chamber and an added impetus for suction air to move into this chamber from the surrounding floor or rug on which the suction nozzle 10 is operating.

The structure of the duct cover 60 is completed by the use of integral half ring-like end pieces 142, 142 (only one of which is shown in FIG. 3), which situate the duct cover within the tunnel 62 during assembly so that the lugs 94, 94, 96, 96 are properly positioned to aid the fastening of the screws 36, 36, 36, 36 to thereby assemble suction nozzle 10.

Turning now to FIG. 4, with the description of FIGS. 2 and 3 in mind, it can be seen that the bottom plate 26 closes the final side (bottom) of the forward and rearward ducts 136, 140, respectively. This is occasioned through the aegis of forward and rearward integral, strip plate pieces 144, 146, respectively, of bottom plate 26. These pieces extend generally between their front and rear screws 36, 36 and 36, 36, respectively, and thereby cover and mask the forward and rearward ducts 136 and 140. The bottom plate 26 is also mounted tightly to the main body 12 by the screws 36, 36, 36, 36 so that suction air passing into the ducts 136 and 140 must first move into the suction nozzle 10 and its agitator chamber 64 by way of the suction openings 32 and 34.

Air passing through the suction openings 32, 34 enters the forward and rearward ducts 136, 140 because the strip plate pieces 144, 146 of the bottom plate 26 are spaced downwardly from terminating bottom edges 148, 150 of duct cover 60. This occurs because front and rear vertical walls 152, 154, respectively, (see FIG. 5) of bottom plate 26 locate the strip plate pieces 144, 146 at this spaced location. A lip 156 (see FIG. 5) on front vertical wall 152 insures the vertical position of the bottom plate 26 relative to main body 12 while a formed groove 158 on rear vertical wall 154 accomplishes the same purpose for it.

Figure 9:
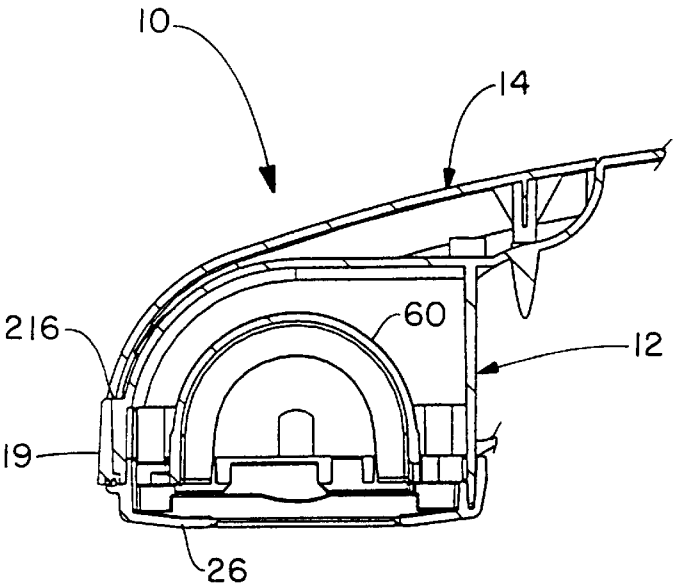
FIG. 9 is a partial cross-sectional view of the duct cover port and its communicating suction nozzle port.

Air moving through the front and rear ducts 136 and 140 is exhausted (FIG. 9) through an exhaust or air exit port 160 in the air exit wall port portion 134. This port is streamlined so as to have an inwardly curved, as if rolled in metal, molded port lip 162. As noted before, the cutout 58, as shown, is aligned with exit port 160 so suction air is free to exit the suction nozzle 10 through this port. Additionally, however the cutout 58 includes a partially rounded air cutout 164 at each side, in a manner, so as to make the cutout 58 streamlined and slightly larger than the air exit port 160 in all its dimensions. To this end then, the major outline of the cutout 58 is a circle of larger dimension than the exit port 160 with scallop edges 164, 164 for streamlining. This arrangement permits the passage of large debris into the suction system of the suction nozzle 10.

Turning now to the assembly arrangement of the hood 14 on the main body 12 (FIGS. 1, 8, 10, 12 and 13). It can be seen that the hood 14 is abbreviated in dimension and includes a pair of curvilinear (in cross-section) rearwardly extending top frame pieces 166, 166, between which, is a narrow forward cross portion 168 which is also curvilinear in cross-section and forms with forward portions of the top frame pieces 166, 166 the front for the suction nozzle 10. The top frame pieces 166, 166 are closed at their rear by a slightly elevated and angled second cross piece 170. The top frame pieces 166, 166, at their rears and along the sides of the suction nozzle 10 have scalloped sections 172, 172 which blend forwardly with transversely extending portions 174, 174 of the hood that extend sidewardly to cover the ends of the tunnel 62. This also gives the suction nozzle 10 a streamlined hammer head hood appearance.

The hood includes, as noted before, the cutout 20 through which the outside somewhat squared and curvilinear portion 106 of cross flow channel 106 can be seen heading rearwardly over the tunnel 62. A portion of the tunnel 62 including, discemably, its outer cylindrical shape compressing surface 104 is also seen extending in a parallel direction along the front of the suction nozzle 10. As well is seen, the raised pad 122 also extends parallel to the front side of the suction nozzle. This provides an open view of these components, especially the cross flow channel and rounded portions of the tunnel, to help the consumer acquire somewhat of a visual impression of the unique duct work of the present inventive nozzle structure.

Disposed within the discontinuity 20 and generally inwardly thereof and extending from an integral vertical wall 178 of main body 12 is a projecting lever 180 having a hook end 182. This lever extends through a notched slot 184 in the vertical wall 178. The lever and slotted wall are a portion of a height adjusting means fully disclosed in previously mentioned U.S. patent application Ser. No. 08/824,769, with the lever capable of moving from notch to notch as the aforesaid height adjusting means operates.

Turning to FIG. 13 where the inside surface of the hood can be mostly easily seen, there is shown a terminating lower border edge 186 which includes a front edge 188 and inwardly bent, right angled, hammer head side edges 190, 190 integrally attached to the front edge of the hood. These hammer head side edges merge into a curvilinear arched section edge 192 that extends generally vertically and slightly rearardly to terminate upwardly in rear overlapping edges 194, 194. These edges smoothly merge at their outer sides with the curvilinear arched section edges 192, 192. Inwardly of the overlapping edges and disposed between them is a vertical cross wall 193 that extends along most of the rear side of the hood.

The main body 12 has a mating edge 196 with which the hood lower border edge 186 melds. It comprises a front flat lip 197 which extends from side to side of the main body 12 at its front side. The front flat lip 197 merges on each side into a side lip 198 which extends generally the width of the tunnel 62 and then merges into an angled (in plan) lip 200 that extends around a rear corner of each end of the tunnel 62. These lips receive the respective hood edges 188, 190, 190 in abutting relationship therewith when the hood is mounted with the main body 12.

At the rear, the main body 12 is provided with an upstanding wall 202, integral therewith. It receives the bottom side of the vertical cross wall 193 of the hood 14 in abutting relationship. A terminating discontinuity 295 in the hood 204 upstanding wall provides clearance for a suction hose connection (not shown) leading to the hard bag (not shown) utilized with suction nozzle 10.

Between the combination of the main body upstanding wall 202 or the discontinuity 295 and the angled corner lips 200 of the main body 12, it is provided with a pair of inset stepped lips 206, 206. These lips extend upwardly and curvilinearly from the rearward terminations of the angled corner lips 200 to form a mating curvilinear lip portion 208, 208 with them. These lips then extend generally horizontally inwardly to form horizontal lip portion 210, 210. The hood curvilinear arched section edges 192, 192 and overlapping edges 194, 194 are positioned to sit against a generally vertical edge 212 of the inset stepped lips 206 of the main body 12 while contiguous inside surfaces 214, 214 and edges 192, 192 of the hood 12 rest on a horizontal edge 216 of the main body hood formed by the front body lip 197, side lips 198, 198 and angled lip 200. The inset, stepped lip 206 is dimensioned so that an outer surface of the hood 218 smoothly forms a continuation of a contiguous outer surface of the main body 12.

This provides a smooth overall outer surface for the suction nozzle 10 with the main body and hood smoothly joining to be coplanar at their terminating upper sides.

The aperture 20 in the hood 14 is completed by a continuous lip 220 extending around its sides and bottom which closes off the area bounded by this same aperture.

It should be clear from the foregoing that the described structure clearly meets the objects of the invention set out in the description's beginning. It should now also be obvious that many changes could be made to the disclosed structure which would still fall within its spirit and purview.

What is claimed is:

1. A suction nozzle including:

a) a transversely extending generally semi-cylindrical wall defining a downward opening agitator chamber therein, said semi-cylindrical wall having a rear bottom edge;

b) a transversely extending duct extending parallel and adjacent to a rear side of said semi-cylindrical wall;

c) a suction applying port confluently communicating with said transversely extending duct; and d) wherein an upwardly extending relief cutout is formed in the rear bottom edge of said semi-cylindrical wall for providing confluent communication between said agitator chamber and said transversely extending duct, whereby large particle dirt and debris in said agitator chamber are moved through said relief cutout, said transversely extending duct and said suction applying port.

2. A suction nozzle according to claim 1, wherein a generally vertically extending rearward portion of said semi-cylindrical wall separates said agitator chamber from said rearward duct and said relief cutout is located in said rearward portion of said semi-cylindrical wall.

3. A suction nozzle according to claim 2, wherein said relief cutout is located concentrically in front of said suction applying port.

4. A suction nozzle according to claim 3, wherein said transversely extending duct expands in cross-sectional area approaching said suction applying port.

5. A suction nozzle according to claim 1, wherein:

a) said suction nozzle includes a bottom plate defining an elongate suction inlet opening located substantially below said agitator chamber; and b) said bottom plate forms a bottom wall of said transversely extending duct.

6. A suction nozzle according to claim 5, wherein said bottom plate is spaced vertically below said rear portion of said semi-cylindrical wall, thereby defining an elongate opening confluently communicating said transversely extending duct with said agitator chamber.

7. A suction nozzle according to claim 6, wherein said suction inlet is delimited by front and rear edges connected by side edges, and wherein said rear edge terminates forward of said rear portion of said semi-cylindrical wall.

8. A suction nozzle according to claim 6, wherein said transversely extending duct expands in cross-sectional area approaching said suction applying port.

9. A suction nozzle including:

a) a transversely extending generally semi-cylindrical wall defining a downward opening agitator chamber therein;

b) a transversely extending duct extending parallel and adjacent to a rear side of said semi-cylindrical wall;

c) a suction applying port confluently communicating with said transversely extending duct;

d) wherein a relief cutout formed in said semi-cylindrical wall confluently communicates said agitator chamber with said transversely extending duct, whereby large particle dirt and debris in said agitator chamber are moved through said relief cutout, said transversely extending duct and said suction applying port;

e) wherein a generally vertically extending rearward portion of said semi-cylindrical wall separates said agitator chamber from said rearward duct and said relief cutout is located in said rearward portion of said semi-cylindrical wall; and f) wherein said relief cutout is located concentrically in front of said suction applying port.

10. A suction nozzle according to claim 9, wherein said transversely extending duct expands in cross-sectional area approaching said suction applying port.

11. A suction nozzle including:

a) a transversely extending generally semi-cylindrical wall defining a downward opening agitator chamber therein;

b) a transversely extending duct extending parallel and adjacent to a rear side of said semi-cylindrical wall;

c) a suction applying port confluently communicating with said transversely extending duct;

d) wherein a relief cutout formed in said semi-cylindrical wall confluently communicates said agitator chamber with said transversely extending duct, whereby large particle dirt and debris in said agitator chamber are moved through said relief cutout, said transversely extending duct and said suction applying port;

e) wherein said suction nozzle includes a bottom plate defining an elongate suction inlet opening located substantially below said agitator chamber; and said bottom plate forms a bottom wall of said transversely extending duct; and f) wherein said bottom plate is spaced vertically below said rear portion of said semi-cylindrical wall, thereby defining an elongate opening confluently communicating said transversely extending duct with said agitator chamber.

12. A suction nozzle according to claim 11, wherein said suction inlet is delimited by front and rear edges connected by side edges, and wherein said rear edge terminates forward of said rear portion of said semi-cylindrical wall.

13. A suction nozzle according to claim 11, wherein said transversely extending duct expands in cross-sectional area approaching said suction applying port.

* * * * *